US007341611B2

(12) United States Patent
Greene et al.

(10) Patent No.: US 7,341,611 B2
(45) Date of Patent: Mar. 11, 2008

(54) COMPACT CYCLONIC BAGLESS VACUUM CLEANER

(75) Inventors: Mason Greene, Auburn, AL (US); Mark Rosenzweig, Chestnut Hill, MA (US)

(73) Assignee: Euro-Pro Operating, LLC, West Newton, MA (US)

( * ) Notice: Subject to any disclaimer, the term of this patent is extended or adjusted under 35 U.S.C. 154(b) by 359 days.

(21) Appl. No.: 10/802,393

(22) Filed: Mar. 17, 2004

(65) Prior Publication Data

US 2005/0223520 A1 Oct. 13, 2005

(51) Int. Cl.
*B01D 45/12* (2006.01)
*B01D 50/00* (2006.01)

(52) U.S. Cl. ..... 55/337; 55/426; 55/429; 55/433; 55/459.1; 55/DIG. 3

(58) Field of Classification Search ..... 55/337, 55/426, 429, 433, 459.1, DIG. 3
See application file for complete search history.

(56) References Cited

U.S. PATENT DOCUMENTS

| | | | | |
|---|---|---|---|---|
| 6,398,973 | B1 | 6/2002 | Saunders et al. | |
| 6,406,505 | B1 | 6/2002 | Oh et al. | |
| 7,014,675 | B2 * | 3/2006 | Nakai et al. | 55/429 |
| 7,070,636 | B2 * | 7/2006 | McCormick et al. | 55/299 |
| 2003/0221277 | A1 | 12/2003 | Oh et al. | |
| 2004/0010885 | A1 * | 1/2004 | Hitzelberger et al. | 15/352 |
| 2004/0098827 | A1 | 5/2004 | Oh et al. | |

FOREIGN PATENT DOCUMENTS

| | | | |
|---|---|---|---|
| EP | 0 033 250 | A1 | 8/1981 |
| EP | 0 928 594 | A1 | 7/1999 |
| GB | 2367512 | A | 4/2002 |
| JP | 2003180581 | | 7/2003 |
| WO | WO 2004/008932 | A1 | 1/2004 |
| WO | WO 2005/041739 | A | 5/2005 |

* cited by examiner

*Primary Examiner*—Robert A. Hopkins
(74) *Attorney, Agent, or Firm*—Greenberg Traurig, LLP; Michael I. Wolfson

(57) ABSTRACT

A compact vacuum container includes a tangential air inlet at the upper portion, a closed top and a central outlet at the bottom having an improved air separation and dirt collection container is provided. A hollow central column with a skirt formed with a downwardly extending flange having an outer diameter is less than the inner diameter of the container, extends from the closed to the bottom outlet opening the upper position above the skirt is open and the lower portion of the column is solid. Dirt particles that separate from the air flow above the skirt drop to the lower portion below the skirt. Clean air then exits an open upper portion of the column to the suction source below the container. The air exiting the bottom of the column may pass through an radially pleated filter before being drawn into the vacuum source.

12 Claims, 3 Drawing Sheets

38
37
24
20
23
34
27
33
A
B
C
21
22
36
C
28
46
32
42
31
44
62
47
41
29
59
40
48
25
59
43

COMPACT CYCLONIC BAGLESS VACUUM CLEANER

BACKGROUND OF THE INVENTION

The invention relates generally to vacuum cleaners, and more particularly to compact bagless vacuum cleaners including a cylindrical cyclonic separation/dirt collection container with a central tube and openable bottom to enhance separation of dirt from the air stream and retention of dirt particles within a lower section of the container.

Cyclonic vacuum cleaners have been known for some time. For example, European Patent No. EP 0 042 723 and U.S. Pat. No. 4,593,429 to James Dyson discloses a vacuum suction cleaning device including two cyclone units in series operating successively to extract dirt particles from an air flow. One of the two cyclones has a substantially frusto-conical shape serving to increase the velocity of the dirt particles so that the cyclone is capable of depositing the fine dust particles in a small diameter collection chamber relative to the diameter of the cone opening. Prior to the air entering the cyclone, dirty air enters tangentially against the wall of a cylindrical outer chamber operating as a cyclone to remove coarse dirt particles from the dirty air entering the device.

In addition to devices wherein the successive cyclones are coaxial as in the above noted publications, Dyson in U.S. Pat. No. 4,373,288 places frusto-conical cyclones side by side. In this configuration, the device is designed to remove dirt through the two cyclones operating in series. The principal objective in all these devices is to avoid the need to utilize a bag as in conventional vacuum cleaners. In these conventional devices, air is drawn through the appliance by a fan that creates a large pressure drop as the bag fills with dirt. This increase in pressure drop lowers the cleaning efficiency of the unit. It is for this reason that configurations for bagless vacuum cleaners are extremely appealing.

A bagless cleaning device is disclosed in WO 99/42198 based on PCT/GB99/00507 by the applicant herein. The full text of this publication is incorporated herein by reference. In this device, dirty inlet air is passed into the upper portion of a cyclone having a cylindrical cross-section and a lower frusto-conical section. This cyclone separation stage is designed to separate fine dirt particles in a collection chamber below the cone opening. The cylindrical portion of the device includes a transition zone connected to an adjacent side chamber for collection of coarse dirt particles. In another embodiment disclosed therein, coarse dirt is collected in an outer larger cylindrical chamber surrounding the inner frusto-conical cyclone separator.

Other bagless vacuum cleaner designs are shown in a series of related applications that issued to Royal Appliance Mfg. Co. based on an application that initially issued as U.S. Pat. No. 6,003,196 on Dec. 21, 1999. These patents disclose various types of upright vacuum cleaners including an air separation chamber that may be a cyclonic separation device. All the vacuum cleaners described in these patents include a filter disposed in the cyclonic air flow chamber or dirt cup upstream of the suction source.

U.S. Pat. No. 6,192,550 to Sanyo Electric Co. Ltd. also discloses a vacuum cleaning device having a rotatable filter disposed in a cyclonic air separation chamber. This device is particularly effective, because the rotatable feature of the filter allows removal of dirt entrained in the filter into the bottom of the dirt cup for easy disposal when the dirt cup is removed for cleaning. The contents of this patent are incorporated herein by reference.

While the use of cyclonic separators provides its own advantage, considerations related to the configuration of the vacuum cleaner as a whole may also affect the viability of the design. Motors used to power a fan to induce air flow tend to be the heaviest single component of the vacuum cleaner. The location of this weight may affect the ease with which the vacuum cleaner may be used. Where the weight of the motor is high relative to the rest of the components of the vacuum cleaner, the resultant high center of gravity for the vacuum may tend to make the assembly less stable for users. Thus, the ability to mount the motor low may offer additional stability and ease of use.

Mounting the motor below the separation chamber lowers the center of gravity of the vacuum cleaner that is important in a compact light weight design. The configuration affects design choices for the separation chamber. The use of a cyclonic separator requires that the chamber be substantially cylindrical, and of a sufficient diameter to allow for cyclonic air flow within. The separation chamber must be removable to allow it to be emptied, cleaned or replaced. Placement of the motor below the separation chamber may result in inefficient power to draw air entering the separation chamber at the top through the separation chamber.

Thus, while many of these bagless designs are improvements over conventional vacuums utilizing bag technology, it remains desirable to provide continued improvements and alternative designs to improve both the separation of dirt particles from air in the air separator chamber in a compact and light-weight design.

SUMMARY OF THE INVENTION

Generally speaking, in accordance with the invention, a compact bagless vacuum cleaner having a cylindrical dirt separation and collection device with a central column is provided. The dirt separation and collection device is a substantially cylindrical container with a closed top, an air inlet at the upper portion and a selectively openable bottom for removed of separated dirt. The central column extends from the closed top of the cylinder to an outlet in the bottom that is pivotally mounted to the container sidewall and selectively openable for emptying. An outwardly and downwardly extending flange or skirt surrounds the mid-point of the central column to prevent reentrainment of dirt into the air stream exiting the container.

A vacuum cleaner in accordance with the invention has an elongated housing hingedly connected to a nozzle with an air inlet for removing dirt from a surface to be cleaned. The housing has an upper end extending to a pipe with a user handle at the top of the pipe. A motor is positioned in the lower portion of the housing above the nozzle. The air separation and collection container is positioned in the house above the motor. A cylindrical radially pleated filter cartridge is positioned in the housing above the motor and below the bottom of the collection container. The upper portion of the central column above the skirt is open and covered with a screen to allow cleaned air to enter. The lower portion of the central column is impervious to the passage of air where dirt is collected. Air entering the container tangentially circulates above the skirt depositing dirt to the bottom and is then drawn into the open upper portion of the column and downwardly into the annular pleated filter cartridge positioned in the housing for filtering air after it leaves the separation container. The filter pleats are radially disposed to increase filtering surface area, before the clean air is drawn into the motor.

Accordingly, it is an object of the invention to provide a dirt separation container for a compact vacuum cleaner that provides improved dirt separation.

It is another object of the invention to provide a dirt separation container including a central column with a downwardly projection skirt to improve dirt separation. A further object of the invention is to provide an air separation and dirt collection container with a central column for use with a vacuum cleaner having a vacuum source in the lower portion of the vacuum housing.

Yet another object of the invention is to provide a compact vacuum cleaner with an easily removable filter cartridge positioned outside the separation container in the vacuum cleaner housing above the vacuum source.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings(s), in which.

DETAILED DESCRIPTION OF THE INVENTION

Figure 1:
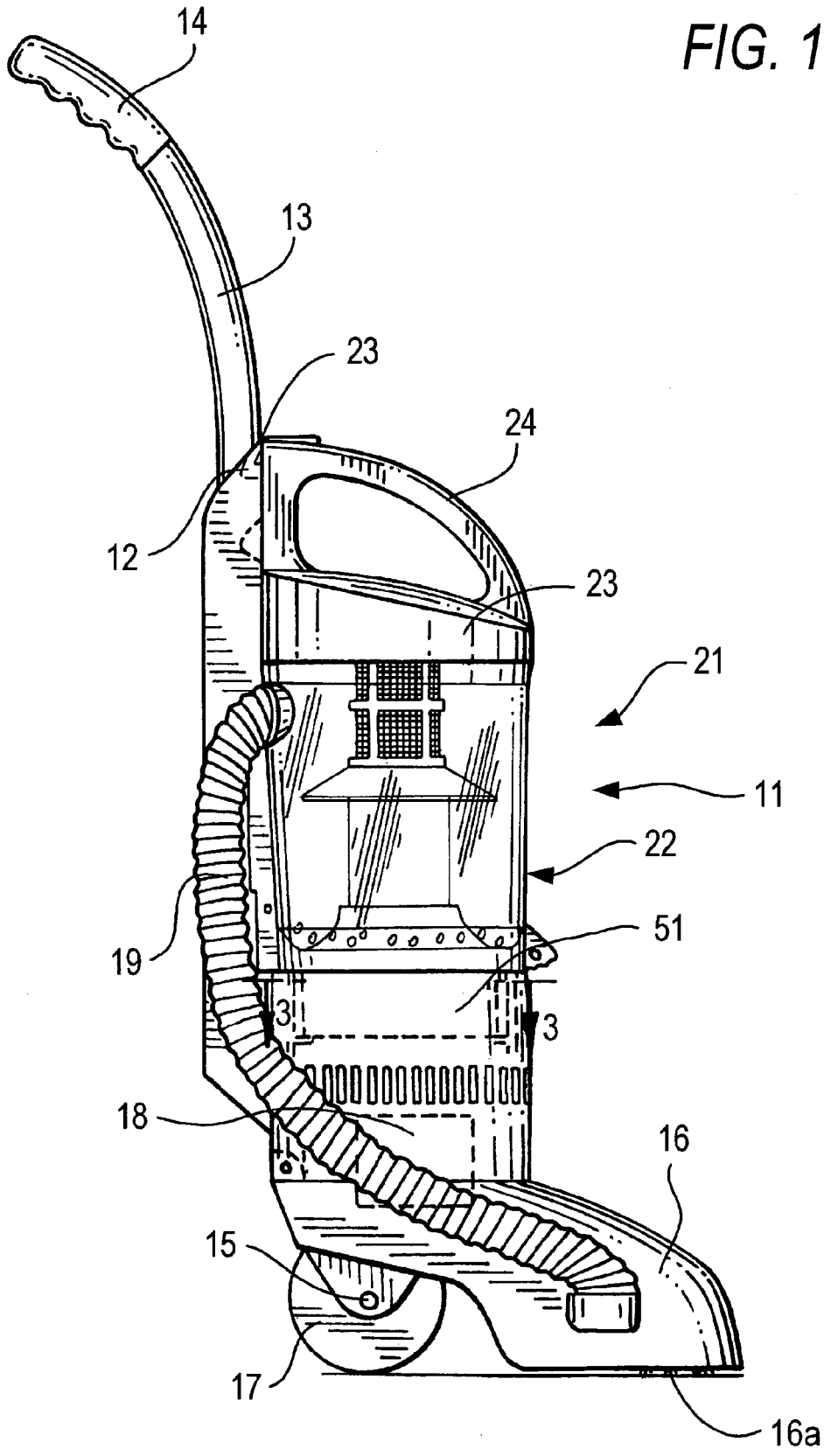
FIG. 1 is a side elevational view of a compact upright vacuum cleaner with a removable cylindrical cyclonic air separation and collection container and a cylindrical filter cartridge constructed and arranged in accordance with the invention.

FIG. 1 shows the main components of a vacuum cleaner 11 having an elongated housing 12 with an upwardly extending pipe 13 terminating in a user handle 14. A suction nozzle 16 is hingedly connected to the bottom of housing 12 for passing over a surface to be cleaned. A selectively removable cylindrical air separation and collection container 21 is positioned in the upper portion of housing 12 above motor 18. A filter cartridge 51 is positioned in housing 12 above motor 18. A conduit 19 provides an airflow connection from nozzle 16 to container 21.

A pair of wheels 17 or rollers are mounted to an axle 15 at the rear lower portion of housing 12 for ease of displacing vacuum cleaner 11 over the surface to be cleaned. A vacuum motor 18 is positioned in the lower portion of housing 12 above wheels 17. This provides a low center of gravity to vacuum cleaner 11. By keeping a low center of gravity, the stability of a compact vacuum cleaner 11 when operated by a user holding handle 14 is improved. This results in ease of use of vacuum cleaner 11.

Figure 2:
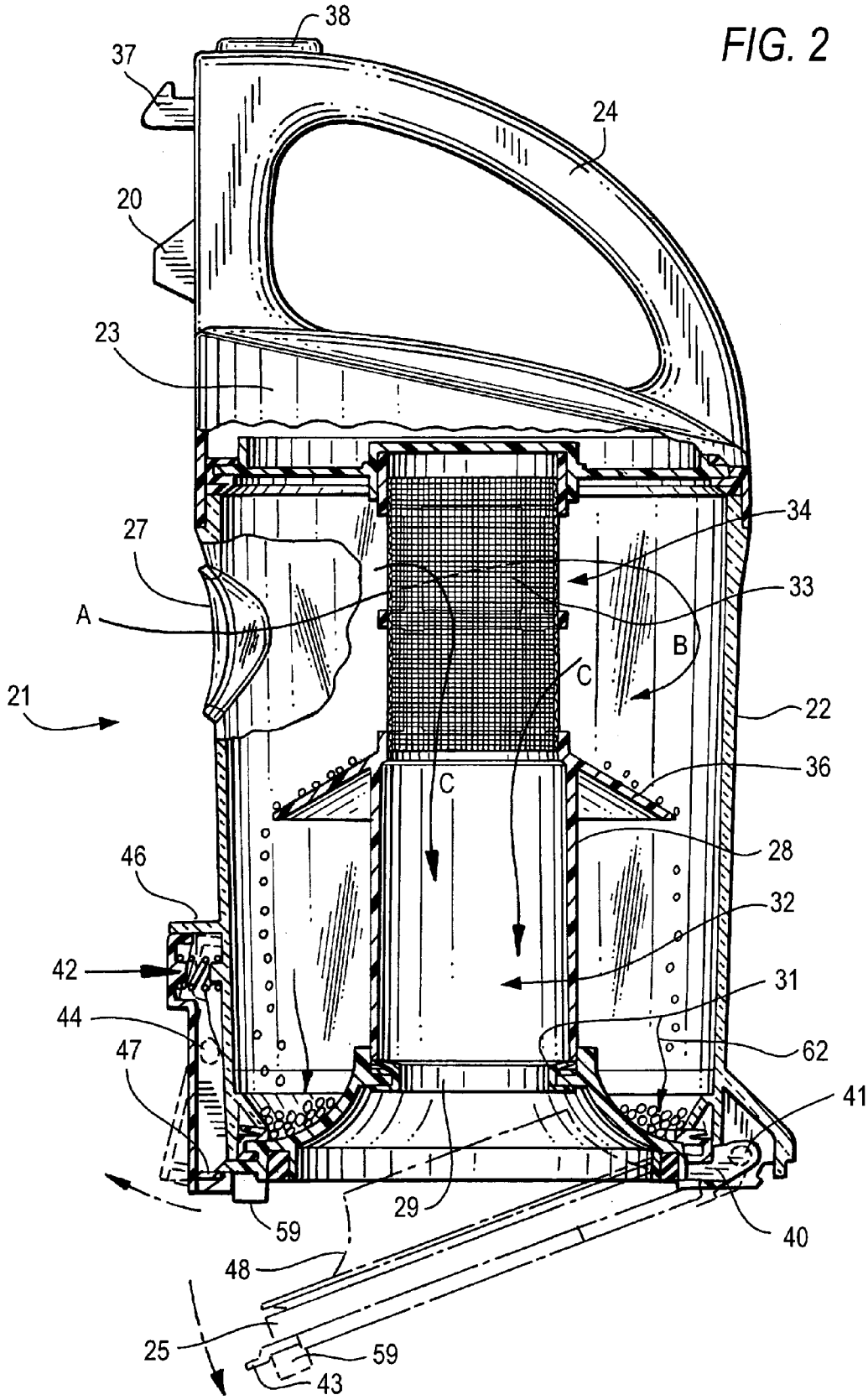
FIG. 2 a cross-sectional view of the separation and collection chamber of FIG. 1 showing the air and dirt pattern.

As shown in more detail in FIG. 2, air separation and collection container 21 has a substantially cylindrical sidewall 22 and a cover 23 with a handle 24 and a selectively openable hinged bottom 25. Sidewall 22 has an air inlet 27 in the upper portion. A central column 28 extends from cover 23 to hinged bottom 25. Bottom 25 is formed with a central outlet opening 29 and has a gasket 31 to insure an airtight connection between column 28 and bottom 25 at outlet opening 29.

Column 28 is hollow with a center cavity 32 to allow air to flow through to motor 18. The lower portion of column 28 is solid and closed to passage of air with an upper portion 30 formed with flow ports 33 to allow air to enter center cavity 32. A screen 34 is placed over ports 33 to prevent debris from passing into column 28 and clogging cavity 32. A outwardly extending and downwardly facing skirt 36 is positioned on the mid-point of column 28. Skirt 36 serves to limit turbulence in lower portion of container 21 and prevent reentrainment of dirt collected on bottom 25. Skirt 36 need not be placed in the exact midpoint of column 28, but should be within about plus or minus 10 per cent of the height of column 28. This will allow for sufficient air separation above skirt 36 and retention of dirt collected below skirt 36.

Cover 23 seals the upper portion of container 21 and includes a handle 24 to facilitate removal of container 21 from housing 12. Handle 24 is formed with a latch 37 with an upwardly facing lip 38 for engaging a ledge in housing 12 to secure container 21 in place when in use. Latch 37 is biased upwardly and has a release button 38 for ease of removal of container 21. Handle 24 also includes a projection 20 for mating with a cavity in housing 12 to insure proper positioning of container 21 in housing 12.

Bottom 25 is pivotally mounted to sidewall 22 by a pin 41 at a bottom hinge portion 26 and held in a closed position as shown by a release lever 42 that engages a lip 43 on bottom 25. Lever 42 is pivotally mounted on a pin 44 and biased in a closed position by a spring hinge. A shoulder 47 in the lower region of lever 42 engages lip 43 to keep bottom 25 securely closed turning use and removal from housing 12 for emptying. Bottom 25 includes a flexible cover or gasket 48 to insure an air-tight fit when bottom 25 is in the closed position as flexible cover 48 is compressed by the bottom of sidewall 22. In order to empty container 21, container 21 is removed from housing 12 and lever 42 is released so that bottom 25 pivots away to release dirt collected thereon.

Figure 3:
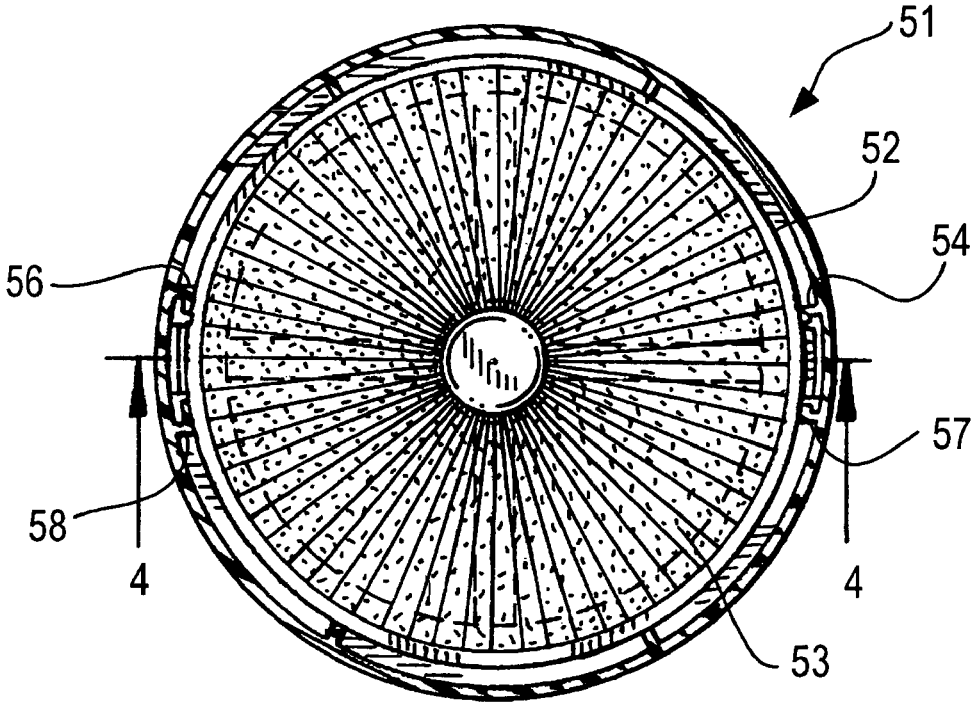
FIG. 3 is a top plan view of a pleated filter cartridge positioned in the vacuum cleaner of FIG. 1 taken along line 3-3.
Figure 4:
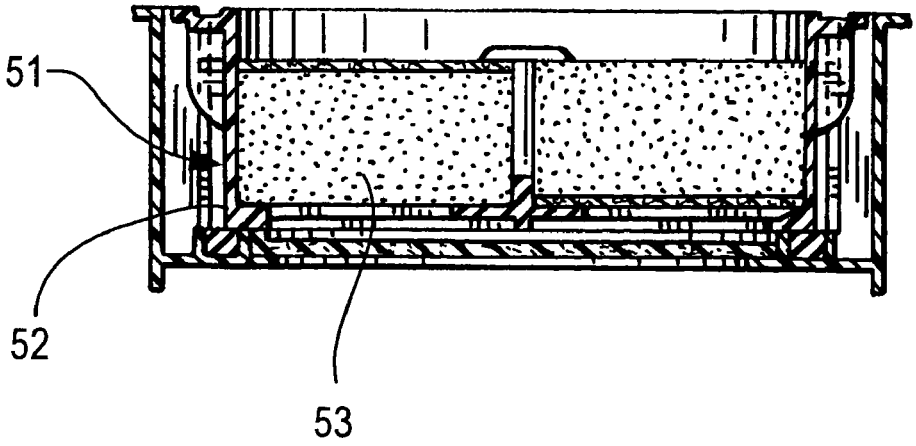
FIG. 4 is cross-sectional view of the filter cartridge of FIG. 3 taken along line 4-4.

Disk-shaped annular pleated filter cartridge 51 is positioned in housing 11 above motor 18 and mates with bottom 25 of container 21 when container 21 is in place in housing 11. Filter cartridge 51 is shown in a top plan view in FIG. 3. Cartridge 51 has a cylindrical shell 52 of plastic material with a pleated filter medium 53 fixed therein. Shell 52 has two opposed tabs 54 and 56 on the outside wall for positioning within corresponding grooves 57 and 58 formed in housing 11. Tabs 54 and 56 insure proper positioning of filter cartridge 51 in housing 11. Bottom 25 of container 21 has two corresponding extending fingers 59 at lip 43 and a groove 61 at hinge portion 40. Fingers 59 and groove 61 provide two recesses to receive tabs 54 and 56 to insure that container 21 is properly sealed in housing 11 over filter cartridge 51.

The filter media may be a high density polyethylene-based open-celled porous media, such as Porex, or air equivalent foraminous filter. A suitable filter medial is a rigid open-celled foam that is moldable or washable into a desired configurations. Preferably, the filter media is a high efficiency particular arrest (HEPA) filter element in radial pleated form with in cartridge 51.

FIG. 2 also illustrates the air flow pattern and dirt collection of air separation and collection container 21 constructed in accordance with the invention. Dirty air enters nozzle 16 and travels up conduit 19 to inlet 27 as shown by an arrow A. Air then travels tangentially within sidewall 22 as shown by an arrow B. Dirt 62 drops out of the air stream and is collected on bottom 25. Clean air shown by an arrow C is then drawn through screen 34 into cavity 32. Air is then drawn down column 28 to through outlet 29 and into filter cartridge 51 due to the vacuum created by motor 18 below.

In the illustrated embodiment, compact vacuum cleaner 11 is about 1 meter or 39 inches in height with container 21 having a diameter of about 110 mm or 4⅜ inches. The overall height of container 21 is about 25 cm. Column 28 has an outer diameter of about 46 mm. Skirt 36 is positioned about 54 mm above the bottom of column 28. Skirt 36 is 26 mm in diameter with an extension of 20.5 mm from the outer diameter of column 28. Thus, skirt 36 extends to between about 70 to 85 percent of the inside diameter of sidewall 22. Preferably, skirt 36 should extend about 75 to 80 percent, and most preferably about 78 percent. Filter cartridge 51 is about 3.5 cm in height.

It will thus be seen that the objects set forth above, among those made apparent from the preceding description, are efficiently attained and, since certain changes may be made in the above construction(s) without departing from the spirit and scope of the invention, it is intended that all matter contained in the above description or shown in the accompanying drawings(s) shall be interpreted as illustrative and not in a limiting sense.

It is also to be understood that the following claims are intended to cover all of the generic and specific features of the invention herein described and all statements of the scope of the invention that as a matter of language, might be said to fall there between.

What is claimed is:

1. An air separation and dirt collection device for a bagless vacuum cleaner comprising:

an elongated container having a cylindrical sidewall;

a closed top and a bottom with a central opening;

a tangential air inlet formed in the upper portion of the sidewall;

a central hollow tube extending the full length of the container having an outwardly and downwardly extending skirt disposed on the mid-portion of the tube;

the upper portion of the center tube above the skirt being open to passage of air with a screen covering the open upper portion of the tube;

the lower portion of the hollow tube being impervious to the passage of air; and the air inlet located opposite the open upper portion of the hollow tube.

2. The air separation and dirt collection device of claim 1, wherein the outer diameter of the skirt extend to between about 70 to 85 percent of the diameter of the cylindrical container.

3. The air separation and dirt collection device of claim 1, wherein the central tube has an outer diameter between about 35 to 45 percent of the diameter of the container sidewall.

4. The air separation and dirt collection device of claim 1, wherein the bottom is hinged to the sidewall and selectively openable for removal of dirt collected thereon.

5. The air separation and dirt device collection of claim 1, wherein the bottom surrounding the central tube is arcuately curved with the inside of the are facing the inside of the container.

6. The air separation and dirt collection device of claim 1, wherein the bottom is configured to engage a disk-shaped filter cartridge positioned against the outside of the bottom.

7. The air separation and dirt collection device of claim 6, wherein the filter cartridge includes a radially pleated filter.

8. The air separation and dirt collection device of claim 6, wherein the pleated filter is a HEPA filter.

9. The air separation and dirt collection device of claim 1, wherein the open upper portion of the column includes a screening covering the openings.

10. A vacuum cleaner including an elongated housing including a suction source and a dirty air inlet and having an opening for receiving a dirt separation and collection container, the container comprising:

an elongated container having a cylindrical sidewall;

a closed top and a bottom with a central opening;

a tangential air inlet formed in the upper portion of the sidewall;

a central hollow tube extending the full length of the container having an outwardly and downwardly extending skirt disposed on the mid-portion of the tube;

the upper portion of the center tube above the skirt being open to passage of air with a screen on the open portion of the tube;

the lower portion of the hollow tube being impervious to the passage of air; and the air inlet located opposite the open upper portion of the hollow tube.

11. An air separation and dirt collection device for a bagless vacuum cleaner comprising:

an elongated container having a cylindrical sidewall;

a closed top and a bottom with a central opening;

a central hollow tube extending the full length of the container having an outwardly and downwardly extending skirt disposed on the mid-portion of the tube;

a tangential air inlet formed in the middle of the region of the sidewall above the skirt;

the upper portion of the center tube above the skirt being open to passage of air;

the lower portion of the hollow tube being impervious to the passage of air; and the air inlet located opposite the open upper portion of the hollow tube.

12. The air separation and dirt collection device of claim 11, wherein the bottom is hinged to the sidewall and selectively openable for removal of dirt collected thereon.

* * * * *